US008056933B2

(12) United States Patent
Liptak

(10) Patent No.: US 8,056,933 B2
(45) Date of Patent: Nov. 15, 2011

(54) QUICK CONNECT FLANGE PLATE

(75) Inventor: William Joseph Liptak, West Palm Beach, FL (US)

(73) Assignee: Dometic Corporation, Elkhart, IN (US)

( * ) Notice: Subject to any disclaimer, the term of this patent is extended or adjusted under 35 U.S.C. 154(b) by 949 days.

(21) Appl. No.: 11/697,525

(22) Filed: Apr. 6, 2007

(65) Prior Publication Data

US 2007/0237634 A1 Oct. 11, 2007

Related U.S. Application Data

(60) Provisional application No. 60/790,478, filed on Apr. 7, 2006.

(51) Int. Cl.
*F16L 25/00* (2006.01)

(52) U.S. Cl. ..... 285/189; 285/326; 285/424

(58) Field of Classification Search ..... 285/67, 285/189, 325, 326, 283, 424; 248/300; 403/321, 403/330

See application file for complete search history.

(56) References Cited

U.S. PATENT DOCUMENTS

| | | | | | |
|---|---|---|---|---|---|
| 558,364 | A | * | 4/1896 | Doolittle | 285/283 |
| 565,499 | A | * | 8/1896 | Pattison | 285/424 |
| 1,339,141 | A | * | 5/1920 | Sharpnack | 285/325 |
| 1,493,221 | A | * | 5/1924 | Northrup | 285/283 |
| 2,135,252 | A | | 11/1938 | Grover | |
| 2,810,514 | A | | 10/1957 | Patrick | |
| 2,950,131 | A | * | 8/1960 | Hennen | 285/424 |
| 3,035,761 | A | | 5/1962 | Kinsworthy | |
| 3,732,030 | A | | 5/1973 | Mullings | |
| 4,130,376 | A | | 12/1978 | Dietsche | |
| 5,083,387 | A | * | 1/1992 | Tillotson et al. | 403/330 |
| 5,470,207 | A | | 11/1995 | Shockey et al. | |
| 5,562,411 | A | | 10/1996 | Salgado | |
| 5,655,795 | A | * | 8/1997 | Strnad et al. | 285/283 |
| 6,077,037 | A | | 6/2000 | Schmidt | |
| 6,168,378 | B1 | | 1/2001 | Craw et al. | |
| 6,587,342 | B1 | | 7/2003 | Hsu | |
| 6,902,373 | B1 | | 6/2005 | Glanton | |
| 2003/0175123 | A1 | | 9/2003 | Yeh | |
| 2005/0029417 | A1 | | 2/2005 | Scheps et al. | |
| 2006/0081353 | A1 | | 4/2006 | Inniger et al. | |

* cited by examiner

*Primary Examiner* — David E Bochna
(74) *Attorney, Agent, or Firm* — Pearne & Gordon LLP

(57) ABSTRACT

A mounting plate connects a first air channeling apparatus and a second air channeling apparatus. The first air channeling apparatus includes an air outlet and a flange projecting outward from the air outlet. The mounting plate is mounted to the second air channeling apparatus and comprises an opening, a first rail, alignment tabs, and a clamp member. The first rail on the mounting plate projects toward the first air channeling apparatus. The alignment tabs project toward the first air channeling apparatus and are configured to align with the air outlet. The clamp member has a first end and a second end. The first end is pivotally connected to the mounting plate and the clamp member includes a second rail. The flange of the first air channeling apparatus is secured between the first rail and the second rail as the clamp member is secured to the mounting plate.

14 Claims, 7 Drawing Sheets

QUICK CONNECT FLANGE PLATE

FIELD OF THE INVENTION

This invention relates to the connection of air channeling apparatuses and, in particular, a mounting plate for quickly connecting air channeling apparatuses.

BACKGROUND OF THE INVENTION

Air moving apparatuses, such as centrifugal fans, are conventionally connected to ducts, distribution boxes or other air directing apparatuses through fastening means such as nuts and bolts, or screws. These fastening means require that the connected parts include apertures for installing the fastening means to. It is possible for the apertures to be defectively machined so that they are misaligned and the connection becomes difficult or even impossible. Moreover, such methods of connection require an installer to use tools or to hold onto the parts for a prolonged period of time in order to keep them aligned while the connecting procedures take place. Furthermore, under conventional methods of connection, air directing apparatuses, such as ducts, must often be routed after the air moving apparatuses, such as fans, are connected and this can lead to an excessive amount of duct that can hinder the air flow through kinks or other restrictions.

There is a need for a simple and time-saving way to connect air moving/directing devices that is also less prone to machining defects and may allow for pre-routing of air directing apparatuses.

SUMMARY OF THE INVENTION

It is an aspect of the present invention to obviate the problems and shortcomings of conventional methods of connecting air channeling apparatuses.

In accordance with one aspect of the invention, a mounting plate for connecting a first air channeling apparatus and a second air channeling apparatus is provided. The first air channeling apparatus includes an air outlet and a flange projecting outward from the air outlet. The mounting plate is mounted to the second air channeling apparatus and comprises an opening, a first rail, alignment tabs, and a clamp member. The opening allows the air channeling apparatuses to be in fluid communication with one another. The first rail on the mounting plate projects toward the first air channeling apparatus. The alignment tabs project toward the first air channeling apparatus and are configured to align with the air outlet. The clamp member has a first end and a second end. The first end is pivotally connected to the mounting plate and the clamp member includes a second rail. The flange of the first air channeling apparatus is secured between the first rail and the second rail as the clamp member is secured to the mounting plate.

In accordance with another aspect of the invention, the clamp member is rendered immovable about the mounting plate through a locking device.

In accordance with yet another aspect of the invention, the clamp member is rendered immovable at the second end and the locking device is a locking pin.

In accordance with yet another aspect of the invention, the first rail and the second rail each form a channel in which the flange of the first air channeling device can be peripherally inserted.

In accordance with yet another aspect of the invention, at least one of the first and second rails resiliently grips the flange thereby holding the flange in place.

In accordance with yet another aspect of the invention, the alignment tabs encircle the opening.

In accordance with yet another aspect of the invention, the first and second rails substantially oppose one another when the second end of the clamp member is secured to the mounting plate.

In accordance with yet another aspect of the invention, the first and second rails limit movement of the outlet in a first direction and the alignment tabs limit movement of the outlet in a second direction, the first and second directions being substantially perpendicular.

In accordance with yet another aspect of the invention, the first and second rails limit movement of the outlet in a vertical direction and the alignment tabs limit movement of the outlet in a horizontal direction.

In accordance with yet another aspect of the invention, the alignment tabs are located peripherally with respect to the opening.

In accordance with yet another aspect of the invention, the mounting plate and the outlet are substantially rectangular.

In accordance with yet another aspect of the invention, the mounting plate and the outlet are substantially non-rectangular.

In accordance with yet another aspect of the invention, at least one of the air channeling apparatuses is a fan.

In accordance with yet another aspect of the invention, a mounting plate assembly for connecting a first air channeling apparatus and a second air channeling apparatus is provided. The first air channeling apparatus includes an air outlet and a flange projecting outward from the air outlet. The mounting plate assembly comprises a mounting plate and a clamp member. The mounting plate is mounted to the second air channeling apparatus and includes an opening, a first rail, and alignment tabs. The opening allows the air channeling apparatuses to be in fluid communication with one another. The first rail on the mounting plate projects toward the first air channeling apparatus. Alignment tabs project toward the first air channeling apparatus and are configured to align with the outlet. The clamp member has a second rail. The flange of the first air channeling apparatus is secured between the first rail and the second rail as the clamp member is secured to the mounting plate.

In accordance with yet another aspect of the invention, the first rail and the second rail each form a channel in which the flange of the first air channeling apparatus can be peripherally inserted.

In accordance with yet another aspect of the invention, at least one of the first and second rails resiliently grips the flange thereby holding the flange in place.

In accordance with yet another aspect of the invention, the first and second rails limit movement of the outlet in a first direction and the alignment tabs limit movement of the outlet in a second direction, the first and second directions being substantially perpendicular.

In accordance with yet another aspect of the invention, the mounting plate and the air outlet are substantially non-rectangular.

In accordance with yet another aspect of the invention, a mounting assembly for connecting air channeling apparatuses comprises a first air channeling apparatus, a clamp member and a second air channeling apparatus. The first air channeling apparatus includes a first opening and alignment tabs adjacent to the first opening. A first flange projects outward from the first opening and a first rail is located on the first flange. The clamp member has a first end and a second end and includes a second rail. The first end is pivotally connected to the first flange. The second air channeling apparatus includes a second opening and a second flange projecting outward from the second opening. The alignment tabs are configured to align with the second opening. The second flange is secured between the first rail and the second rail as the second end of the clamp member is secured to the first flange in a way that the first and second air openings are in fluid communication with one another.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION OF THE INVENTION

Figure 1:
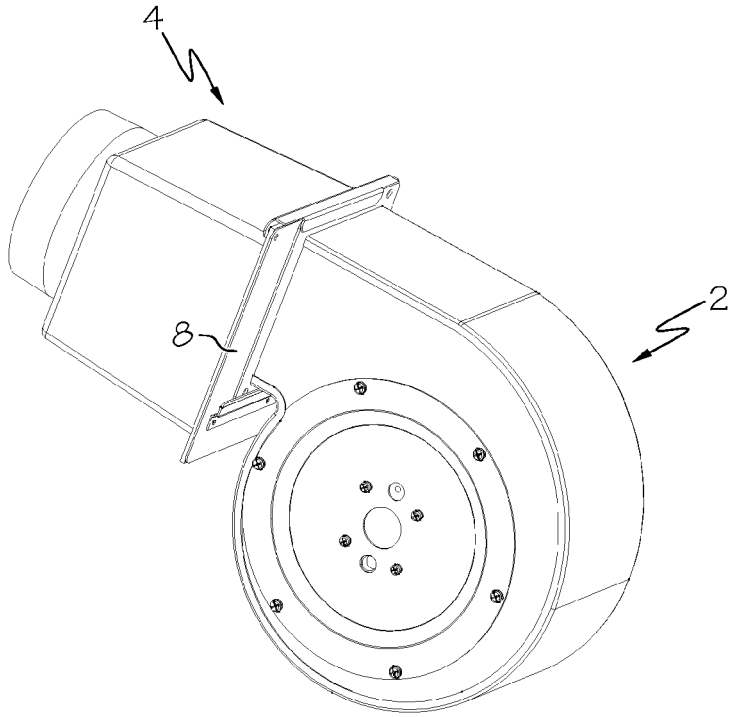
FIG. 1 is a perspective view of a first embodiment of a connection using a mounting plate of the present invention between air channeling apparatuses.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

Figure 2:
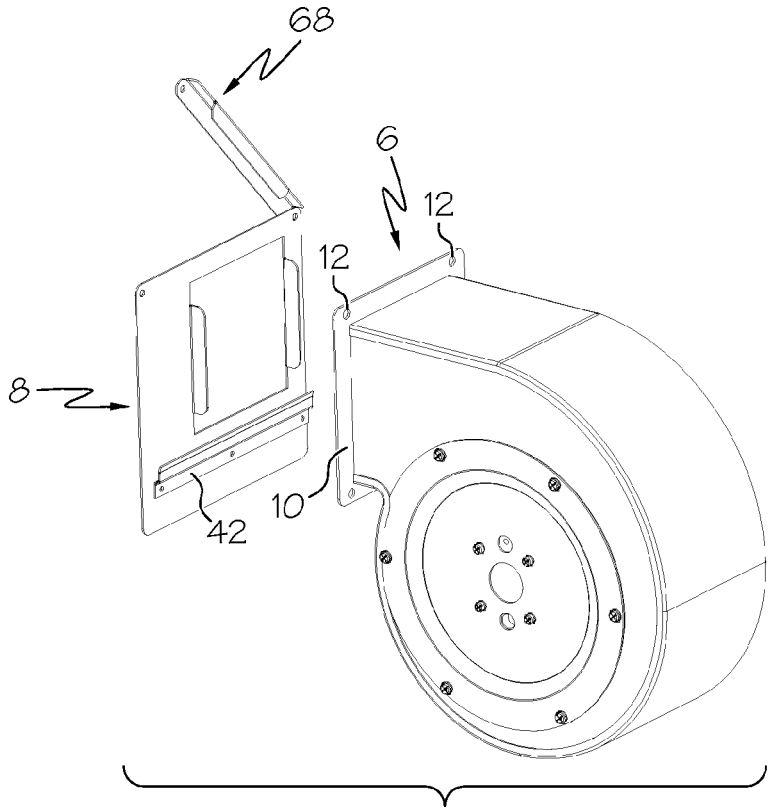
FIG. 2 is an exploded perspective view of the connection using the mounting plate.
Figure 6A:
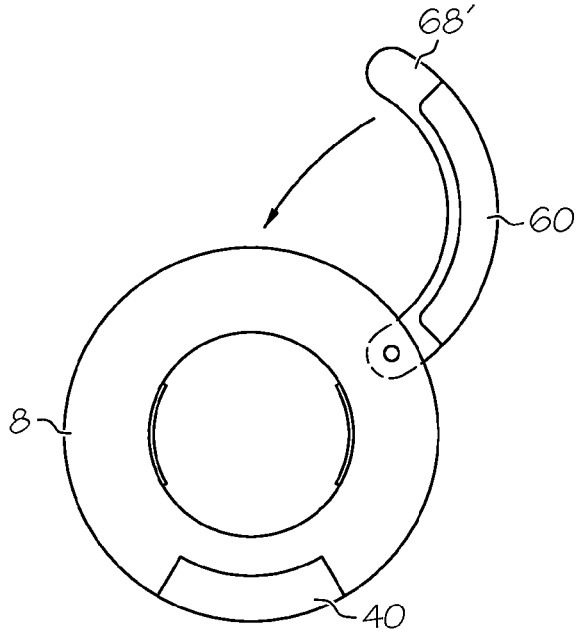
FIG. 6A is a second embodiment of the mounting plate connection prior to clamping.

FIG. 1 shows an example embodiment of the present invention in which an air moving apparatus 2 is mounted to an air distribution box 4. In this embodiment, the air moving apparatus 2 is a centrifugal fan that is powered by a motor (not shown) rotating fan blades (not shown) housed within the fan. In a centrifugal fan, an air outlet 6 from which air exits is often rectangular in shape (FIG. 2). However, a different type of air moving apparatus 2, such as an axial fan, may be used and the air outlet 6 may have various shapes, such as a circle (FIG. 6A). In FIG. 1, a mounting plate 8 connects the air moving apparatus 2 to the air distribution box 4 at the air outlet 6 in a manner to be described later.

Although FIG. 1 shows an air moving apparatus 2 and an air distribution box 4, the present invention relates to the connection of a variety of air channeling apparatuses and that present invention is not limited to the connection illustrated in this embodiment. The term "air channeling apparatus" is defined to encompass air directing devices such as distribution boxes, duct tubes, duct rings, plenum attachments or adapters, air moving apparatuses such as centrifugal fans or axial fans, and any other means for transmitting, directing or moving air in a desired manner. Moreover, the present invention has broad applicability in various environments where air is transmitted, directed or moved including, but not limited to, housing applications, commercial applications, recreational vehicles, mobile homes or nautical vehicles.

FIG. 2 shows the air moving apparatus 2 and the mounting plate 8 of the present invention in a detached state. The air moving apparatus 2 has an outward projecting flange 10 around the air outlet 6. The flange 10 generally has a shape similar to that of the air outlet 6 but need not do so. The flange 10 generally has a number of apertures 12 for fastening the air outlet 6 of the air moving apparatus 2 with other air channeling apparatuses via screws. However, such fastening apertures 12 are not used if the present invention is implemented. When the mounting plate 8 is connected with an air channeling apparatus other than an air moving apparatus with a flange, the air channeling apparatus will be equipped with a structure similar to the flange 10 of the air outlet 6.

As shown in FIGS. 3A-3B and 4A-4C, the mounting plate 8 is a substantially flat element with an opening 14 that extends through the mounting plate 8 and allows air to flow through from one air channeling apparatus to another so that they are in air communication with one another. The shape and dimensions of the opening 14 are such that the opening 14 will not act as a hindrance to the air flow. Thus, the opening 14 will ideally be at least as large as the air outlet 6 of the air moving apparatus 2. However, the present invention encompasses situations where the opening 14 is smaller than the air outlet 6. The mounting plate 8 will generally be made of material, such as various types of steel, able to withstand a range of temperatures in which air channeling apparatuses operate.

Figure 3B:
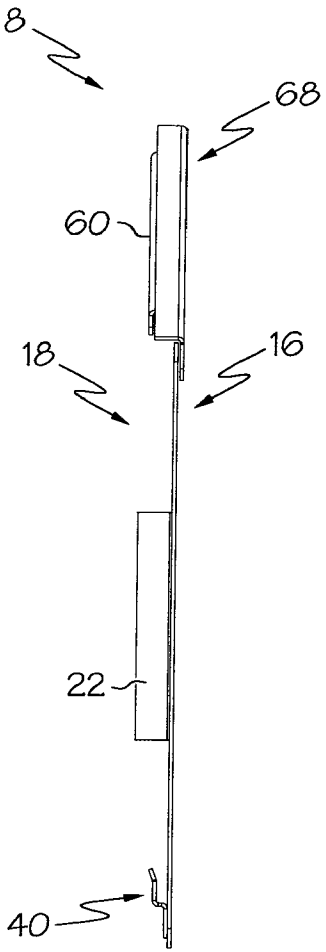
FIG. 3B is a side view of the mounting plate prior to clamping.

As shown in FIG. 3B, the mounting plate 8 has a first side 16 and a second side 18. In this embodiment, the first side 16 is substantially flat being free of any projections and the mounting plate 8 is mounted to air channeling apparatuses through welding, gluing, screwing, riveting or other means on the first side 16.

Figure 4A:
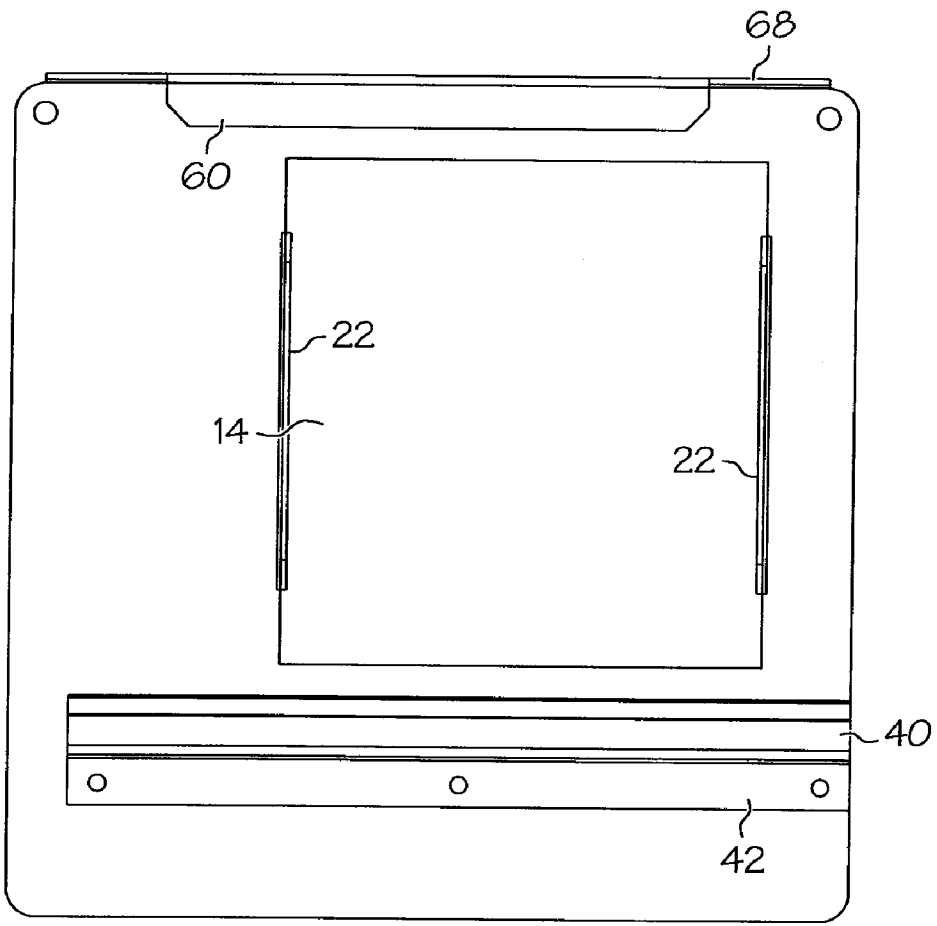
FIG. 4A is a front view of the mounting plate after clamping.
Figure 4C:
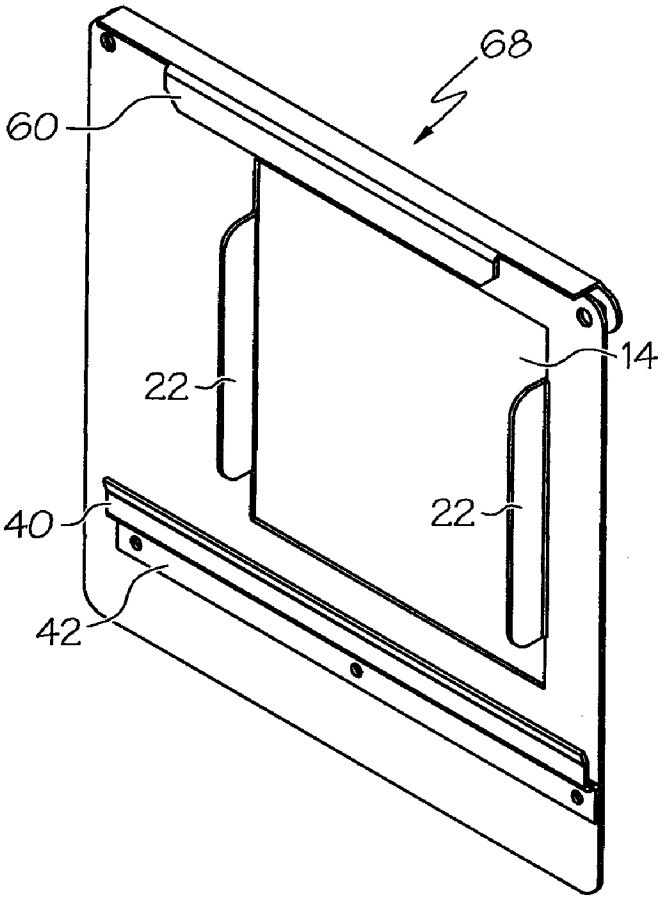
FIG. 4C is a perspective view of the mounting plate after clamping.
Figure 4B:
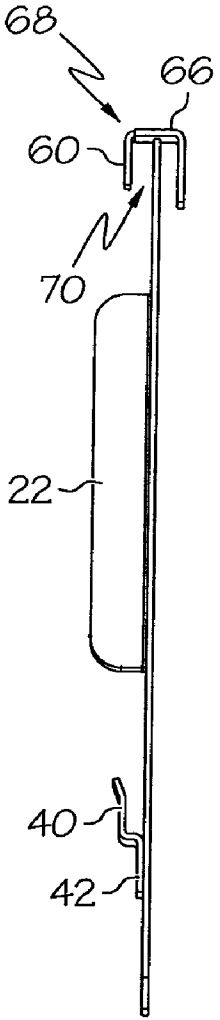
FIG. 4B is a side view of the mounting plate after clamping.
Figure 5A:
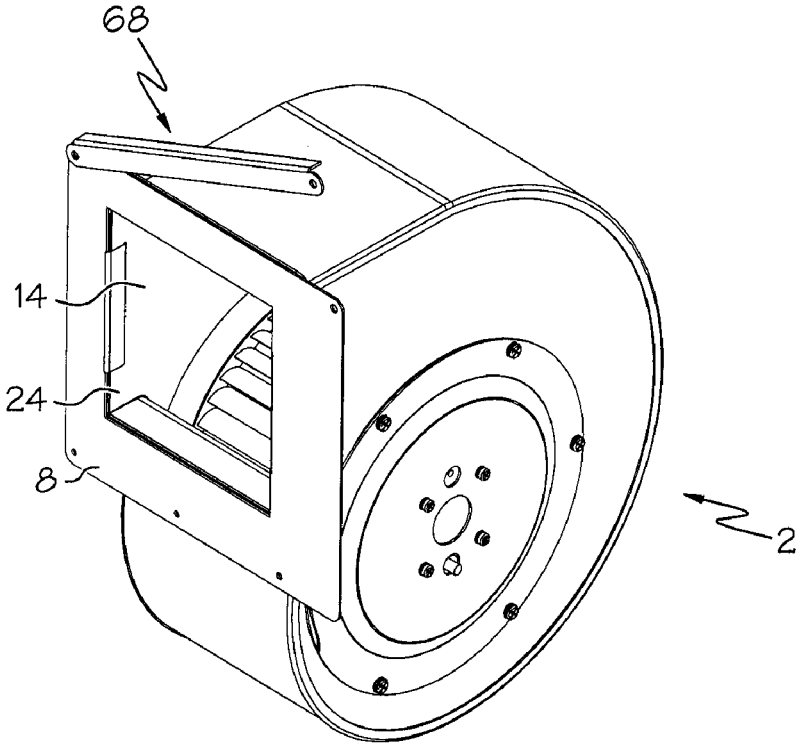
FIG. 5A is a first perspective view of the mounting plate and the air moving apparatus showing alignment tabs within an air outlet of the air moving apparatus.
Figure 6B:
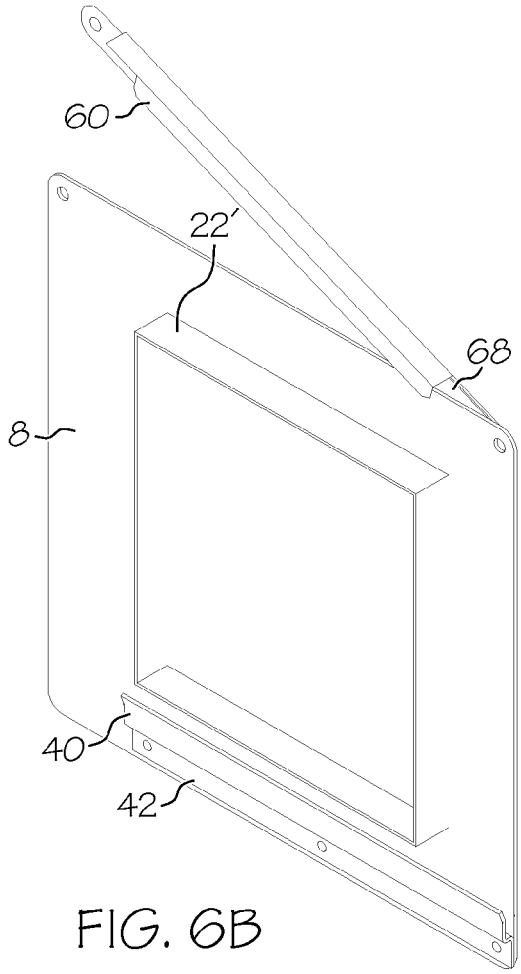
FIG. 6B is a third embodiment of the mounting plate connection prior to clamping.

As shown in FIGS. 4A-4C, along certain portions of a periphery 20 of the opening 14 of the mounting plate 8, alignment tabs 22 project from the second side 18 in order to help align the air outlet 6 of the air moving apparatus 2 with the opening 14 of the mounting plate 8. Thus, when assembled, the alignment tabs 22 will project into the air outlet 6 in order to ensure a close fitting with the periphery 24 of the air outlet 6 (FIG. 5A) and to prevent possible slippage between the flange 10 and the second side 18 of the mounting plate 8 after connection. In this embodiment, the alignment tabs 22 will restrict horizontal movement of the mounting plate 8 with respect to the air outlet 6. The alignment tabs 22 may project from different portions of the periphery 20 of the opening 14 and the restriction of movement will vary accordingly. It would also be possible for the alignment tabs 22 to substantially encircle the opening 14 as shown in FIG. 6B.

As shown in FIGS. 3A-3B, 4A-4C and 5B, the mounting plate 8 also includes a first rail 40 that projects on the second side 18 so that it can capture a portion of the flange 10 of the air moving apparatus 2. In this embodiment, an elongate bracket 42 has an upwardly bent projecting surface that acts as the first rail 40 and, when the bracket 42 is fastened to the bottom of the mounting plate 8 with screws, it creates a first capture area 46 in the form of a channel. In this manner, the first capture area 46 can receive a bottom portion of the flange 10. As shown in FIG. 3C, the width of the first capture area 46 of the first rail 40 can be configured to be smaller than the thickness of the flange 10 so that the flange 10 will be tightly gripped by the first rail 40. A lip 48 of the first rail 40 is bent away from the mounting plate 8 to accommodate entry of the flange 10 into the first capture area 46. If the first rail 40 is made of material having a resilient characteristic, it can help accommodate multiple connection and disconnection of air channeling apparatuses. The gripping mechanism can be accomplished in various ways such as by configuring the first rail 40 to be at a slight incline from a parallel position relative to the second side 18 of the mounting plate 8. The first rail 40 can be formed by using brackets 42 of various shapes, such as one forming a capture area 46 through a U-shaped cross section. When the first rail 40 is embodied in a bracket 42 fastened to the mounting plate 8, the bracket 42 will include fastening apertures 50 for screws. The first rail 40 can instead be created by welding, gluing or fastening a separate part, such as the bracket 42, or may be an integral part of the mounting plate 8 created by molding or other material processing methods. In the latter cases, the bracket 42 as shown in this embodiment will not be used.

Figure 3A:
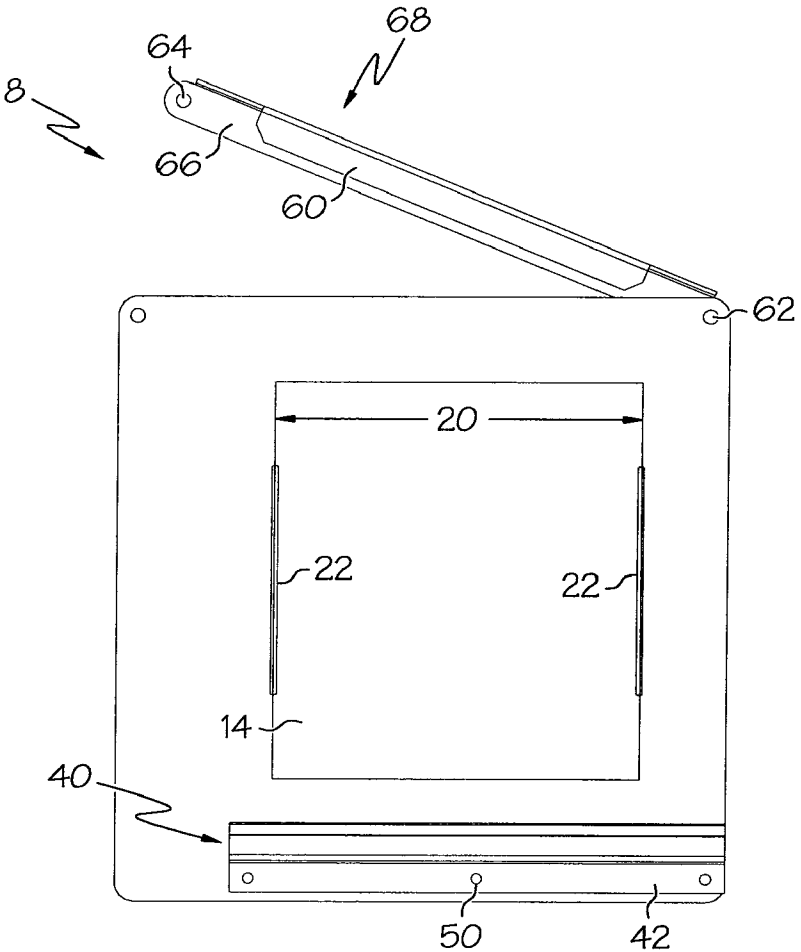
FIG. 3A is a front view of the mounting plate prior to clamping.
Figure 3C:
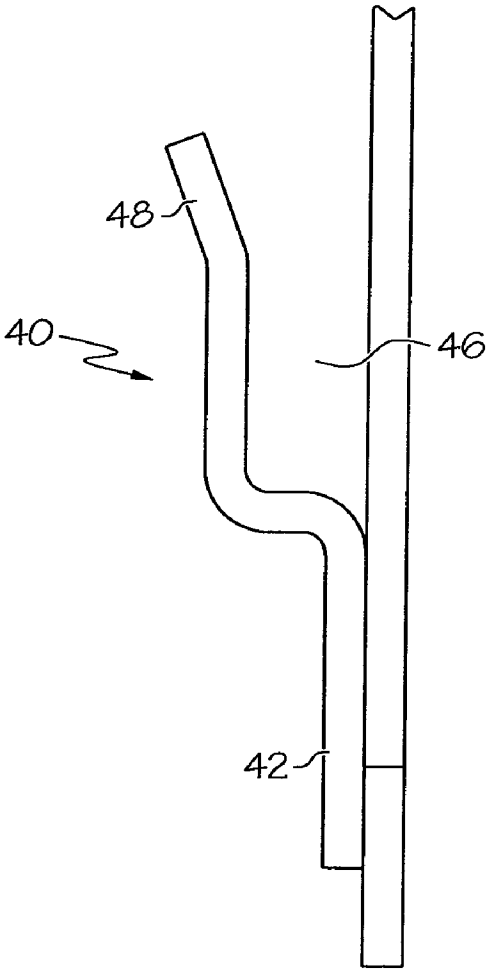
FIG. 3C is a close-up view of a first rail of the mounting plate.

FIGS. 3A, 4A and 4C also shows a clamp member 68 that has a first end 62 and a second end 64 and that is pivotally connected at the first end 62 to an edge of the mounting plate 8. In this embodiment, as shown in FIGS. 4B and 4C, the clamp member 68 is an elongate bracket 66 with a downwardly projecting surface that acts as a second rail 60 and creates second capture area 70. The second rail 60, similarly to the first rail 40, receives a portion of the flange 10 of the air moving apparatus 2 and can be configured to tightly grip a portion of the flange 10. A pin can be inserted at the first end 62 to pivotally connect the clamp member 68 to the mounting plate. However, various pivoting mechanisms can be used. As shown in FIGS. 4A-4C, the clamp member 68 rests on a portion of the flange 10 of the air moving apparatus 2 and a portion of the mounting plate 8 when the clamp member 68 is pivoted and the second end 64 becomes secured to the mounting plate 8. The second end 64 can be secured through any kind of locking device, such as a locking pin. A locking device that can secure the clamp member 68 without a tool will make installation more convenient. Moreover, the clamp member 68 need not be secured to the mounting plate 8 at the second end 64 and, for example, a middle portion of the clamp member 68 can be fastened to the mounting plate 8 instead.

In this embodiment, the first rail 40 and the second rail 60 will restrict vertical movement after the clamp member 68 is secured to the mounting plate 8. However, depending on the relative shape and position of the first rail 40 and the second rail 60, the manner in which the movement of the flange 10 is restricted by the rails 40, 60 will vary. Alternatively, it is possible for the first and second rails 40, 60 to restrict horizontal movement while the alignment tabs 22 restrict vertical movement. It would also be possible for the first and second rails 40, 60 to restrict movement in a first direction while the alignment tabs 22 restrict movement in a second direction orthogonal to the first direction in which neither the first direction nor the second direction is vertical or horizontal. An example of such an embodiment would be if the alignment tabs 22 and the rails 40, 60 were substantially L-shaped and were located in diagonally opposite corners of the opening 14 and the mounting plate 8 respectively. If the shapes of the flange 10 and the mounting plate 2 were different, the location and geometry of the alignment tabs 22 and the first and second rails 40, 60 will change accordingly. FIG. 6A is such an example.

Figure 5B:
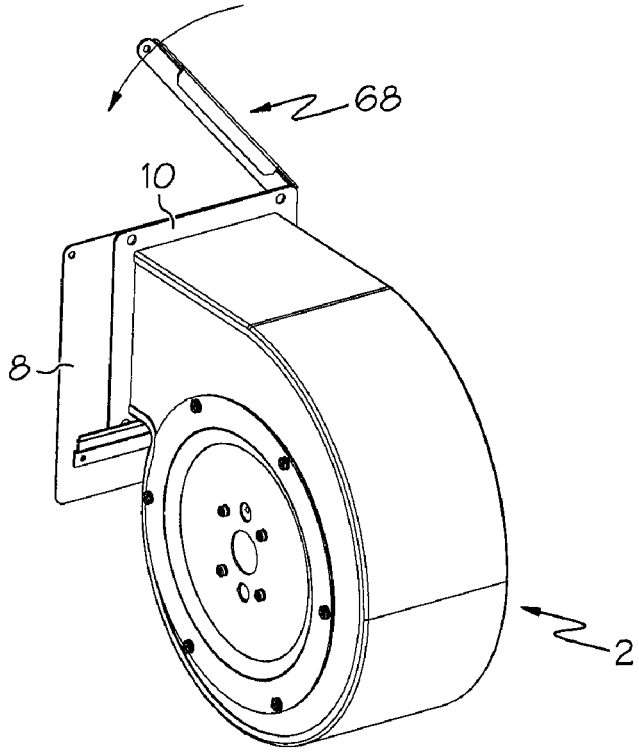
FIG. 5B is a second perspective view of the mounting plate and the air moving apparatus showing a flange of the air moving apparatus within the first rail of the mounting plate.

For this embodiment, the connection of air channeling apparatuses using the mounting plate 8 of the present invention is accomplished by first mounting the first side 16 of the mounting plate 8 onto an air channeling apparatus, such as an air distribution box, to which another air channeling apparatus, such as an air moving apparatus, must connect. Then, a portion of the flange 10 of the air moving apparatus 2 is inserted into the first rail 40 while aligning the air outlet 6 of the air moving apparatus 2 to the alignment tabs 22 of the mounting plate 8 (FIG. 5A). Once the flange 10 of air moving apparatus 2 rests against the second side 18 of the mounting plate 8, the clamp member 68 is rotated to rest against the mounting plate 8 and the flange 10 (FIGS. 1 and 5B). Then, the second end 64 of the clamp member 68 is secured to the mounting plate 8 to hold the flange 10 of the air moving apparatus 2 in place against the mounting plate 8.

In a different embodiment of the invention, it would be possible to have a mounting plate assembly in which the first end 62 of the clamp member 68 is not pre-attached through a pivoting connection to the mounting plate 8 and in which the first and second ends 62, 64 of the clamp member 68 are secured during connection of the air channeling apparatuses.

Figure 7:
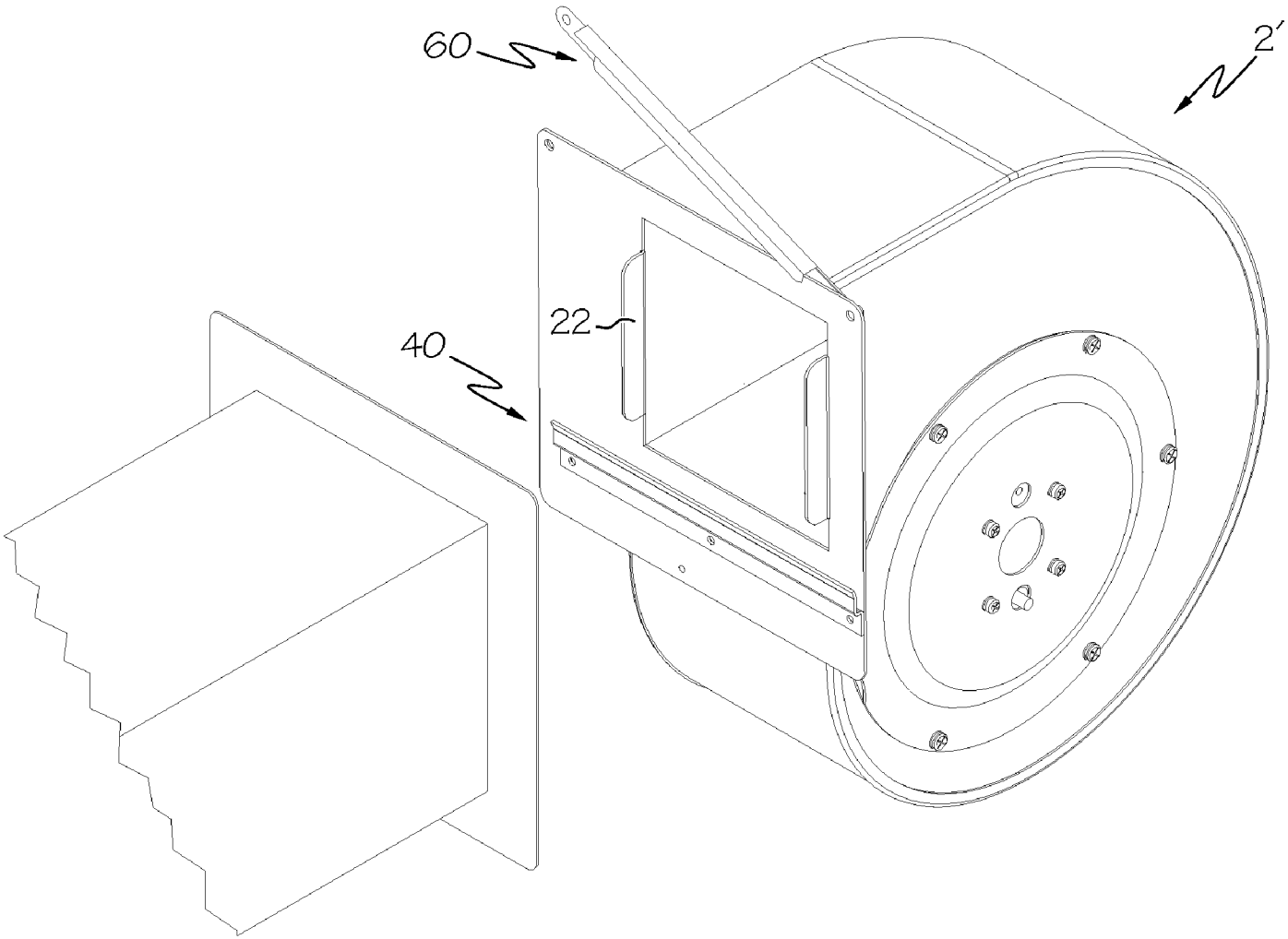
FIG. 7 is a fourth embodiment of the mounting plate connection prior to clamping.

FIG. 7 shows yet another embodiment of the present invention in which the alignment tabs 22 and the rails 40, 60 exist on or adjacent to the flange 10 of the air moving apparatus 2. The air moving apparatus 2 can be brought into air communication with an air channeling apparatus through the alignment tabs 22 and the rails 40, 60 in the same manner as described above.

The present invention allows the air channeling apparatuses to be connected without the use of tools and without the trouble of having to hold the apparatuses for an extended period of time. Another advantage of the present invention is that it provides an alternative means of connecting air channeling apparatuses where the connection has become impossible due to defects in the apertures.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed:

1. A mounting plate for connecting a first air channeling apparatus and a second air channeling apparatus, the first air channeling apparatus including an air outlet and a flange projecting outward from the air outlet, the mounting plate being mounted to the second air channeling apparatus, the mounting plate comprising:

an opening adapted to allow the air channeling apparatuses to be in fluid communication with one another, a first rail on the mounting plate adapted to project toward the first air channeling apparatus, alignment tabs adapted to project toward the first air channeling apparatus, the alignment tabs being configured to align with the air outlet, and a clamp member having a first end and a second end, the first end pivotally connected to the mounting plate, the clamp member including a second rail, wherein a portion of the clamp member is positioned on a first side of the mounting plate and the second rail is positioned on a second side of the mounting plate, wherein the first rail and the second rail are adapted to secure a flange of the first air channeling apparatus therebetween as the clamp member is secured to the mounting plate.

2. The mounting plate of claim 1, wherein the clamp member is rendered immovable about the mounting plate through a locking device further wherein the clamp member extends along an edge of the mounting plate.

3. The mounting plate of claim 2, wherein the clamp member is rendered immovable at the second end and the locking device is a locking pin, further wherein the portion of the clamp member and the second rail are configured to extend along opposing sides of the mounting plate.

4. The mounting plate of claim 1, wherein the first rail and the second rail each form a channel in which the flange of the first air channeling device can be peripherally inserted.

5. The mounting plate of claim 4, wherein at least one of the first and second rails is adapted to resiliently grip the flange thereby holding the flange in place, wherein at least one of the first and second rails extends along substantially the entire length of a side of the opening.

6. The mounting plate of claim 1, wherein the alignment tabs encircle the opening.

7. The mounting plate of claim 1, wherein the first and second rails are opposite one another when the second end of the clamp member is secured to the mounting plate.

8. The mounting plate of claim 1, wherein the first and second rails limit movement of the outlet in a first direction and the alignment tabs limit movement of the outlet in a second direction, the first and second directions being substantially perpendicular.

9. The mounting plate of claim 8, wherein the first and second rails limit movement of the outlet in a vertical direction and the alignment tabs limit movement of the outlet in a horizontal direction.

10. The mounting plate of claim 1, wherein the alignment tabs are located peripherally with respect to the opening.

11. The mounting plate of claim 1, wherein the mounting plate and the outlet are substantially rectangular.

12. The mounting plate of claim 1, wherein the mounting plate and the outlet are non-rectangular.

13. A mounting assembly for connecting air channeling apparatuses, comprising:

a first air channeling apparatus including a first opening and alignment tabs adjacent to the first opening, a first flange projecting outward from the first opening, a first rail located on the first flange;

a clamp member having a first end and a second end, the clamp member including a second rail, the first end pivotally connected to the first flange, wherein a portion of the clamp member is positioned on a first side of the first flange and the second rail is positioned on a second side of the first flange; and a second air channeling apparatus including a second opening, a second flange projecting outward from the second opening, the alignment tabs being configured to align with the second opening, wherein the second flange is secured between the first rail and the second rail as the second end of the clamp member is secured to the first flange in a way that the first and second air openings are in fluid communication with one another.

14. The mounting assembly of claim 13, wherein the clamp member extends along substantially the entire length of a side of the first opening.

* * * * *